US009255483B2

(12) United States Patent
Farineau et al.

(10) Patent No.: US 9,255,483 B2
(45) Date of Patent: Feb. 9, 2016

(54) LOCKING BLADE FOR A ROTOR

(71) Applicant: General Electric Company, Schenectady, NY (US)

(72) Inventors: Thomas Joseph Farineau, Schoharie, NY (US); Timothy Scott McMurray, Fultonville, NY (US)

(73) Assignee: General Electric Company, Schenectady, NY (US)

( * ) Notice: Subject to any disclaimer, the term of this patent is extended or adjusted under 35 U.S.C. 154(b) by 556 days.

(21) Appl. No.: 13/668,996

(22) Filed: Nov. 5, 2012

(65) Prior Publication Data

US 2014/0127026 A1 May 8, 2014

(51) Int. Cl.

| | |
|---|---|
| ***F03B 3/12*** | (2006.01) |
| ***F01D 5/30*** | (2006.01) |
| ***F01D 5/32*** | (2006.01) |
| *F01D 5/22* | (2006.01) |

(52) U.S. Cl.

CPC ..... *F01D 5/3038* (2013.01); *F01D 5/32* (2013.01); *F01D 5/225* (2013.01)

(58) Field of Classification Search

CPC ..... F01D 5/32; F01D 5/3038; F01D 5/3023; F01D 5/303; F01D 5/3015; F01D 5/3053; F01D 5/323; F01D 11/008; F01D 5/30; F01D 5/326; F01D 5/3007; F01D 5/3046; F01D 5/3069

See application file for complete search history.

(56) References Cited

U.S. PATENT DOCUMENTS

| | | | | |
|---|---|---|---|---|
| 1,289,278 | A * | 12/1918 | Schmidt | 416/217 |
| 1,687,891 | A * | 10/1928 | Ray | F01D 5/3038 407/107 |
| 3,012,308 | A * | 12/1961 | Zech et al. | 29/889.7 |
| 7,901,187 | B2 | 3/2011 | Barber | |
| 7,972,113 | B1 * | 7/2011 | Davies | 416/214 A |

OTHER PUBLICATIONS

U.S. Appl. No. 13/448,238, filed Apr. 16, 2012.

* cited by examiner

*Primary Examiner* — Dwayne J White
*Assistant Examiner* — Julian Getachew
(74) *Attorney, Agent, or Firm* — Ernest G. Cusick; Hoffman Warnick LLC

(57) ABSTRACT

A locking blade for a rotor can include an airfoil portion with a root from which a tongue extends. Opposed bucket segments can engage the tongue and can be retained in a longitudinal direction of the blade by a fastener, such as a pin, that can extend through holes in the segments and tongue. Tines parallel to and on opposite sides of the tongue can extend from the root and include holes through which the fastener can extend, the bucket segments extending between respective tines and the tongue. The structure can eliminate an assembly gate in a rotor.

12 Claims, 8 Drawing Sheets

LOCKING BLADE FOR A ROTOR

BACKGROUND OF THE INVENTION

The disclosure relates generally to rotor assemblies, and more particularly to blade or bucket design and mounting in turbine rotors.

A rotor includes a plurality of blades or buckets whose roots are typically mounted on a rotating body, such as a shaft or the like, often referred to as a wheel. Each blade or bucket root may include a profile that is typically shaped to be retained against radial motion when mounted in a groove in the body so that the blade may slide in the groove but not come out of the groove. For example, the blade root and groove may include complementary dovetails including a bucket or blade hook and a wheel hook that cooperate to retain the bucket dovetails in the groove. To enable insertion of the bucket roots into the groove, the blade hook region is typically cut to form an assembly gate. The assembly gate is generally one bucket width along the circumference. Special arrangements must be made to retain the blade(s) at the assembly gate. The assembly gate is typically cut through wheel hooks in the groove, which may reduce the load bearing capacity of the gate area. Additionally, natural frequencies of the rotor may be affected by the assembly gate, as may balancing of the rotor.

BRIEF DESCRIPTION OF THE INVENTION

Embodiments of the invention disclosed herein may take the form of a locking blade for a rotor, the locking blade including a blade body portion with a tip at a first end and a root at a second end opposite the first end. The root can include a tongue extending away from the tip, and a bucket portion of the locking blade can include a bucket dovetail having a blade hook portion. The bucket dovetail can receive and retain the tongue against relative motion with respect to the bucket dovetail.

Another embodiment may include a locking blade for a rotor, the locking blade including a blade body and a bucket dovetail. The bucket dovetail can be configured to support the locking blade and to be retained against radial movement in and by a substantially circumferential wheel dovetail in the rotor. The bucket dovetail can further be further configured to retain the blade body against movement relative to the bucket dovetail. A tongue can extend from a root of the blade body portion and can include a root through hole configured to allow a fastener to extend therethrough. A first bucket segment can engage a first side of the tongue and can include a first bucket through hole that selectively registers with the root through hole of the tongue. The bucket dovetail can also include a second bucket segment that can engage a second side of the tongue and can include a second bucket through hole that selectively registers with the root through hole of the tongue and the first bucket through hole. A fastener can extend through the root and bucket through holes of the bucket segments and the tongue to retain the blade body portion against movement relative to the bucket dovetail.

A further embodiment may take the form of a locking blade for a rotor, the locking blade having a blade body and a bucket dovetail. The blade body can include a root, and at least one tine can extend from the root. The bucket dovetail can include substantially identical first and second bucket segments, each bucket segment including a respective engagement surface configured to engage a respective surface of the at least one tine. Corresponding through holes can be formed in each of the at least one tine and each of the bucket segments so that the through holes register with each other when the engagement surfaces are engaged, allowing a fastener to be inserted through the through holes when the engagement surfaces engage the tongue, thereby constraining the tongue against motion out of the bucket dovetail.

Other aspects of the invention provide additional apparatus, methods, methods of using, and methods of assembling, which include and/or implement some or all of the actions and/or features described herein. The illustrative aspects of the invention are designed to solve one or more of the problems herein described and/or one or more other problems not discussed.

BRIEF DESCRIPTION OF THE DRAWING

These and other features of the disclosure will be more readily understood from the following detailed description of the various aspects of the invention taken in conjunction with the accompanying drawings that depict various aspects of the invention.

It is noted that the drawings may not be to scale. The drawings are intended to depict only typical aspects of the invention, and therefore should not be considered as limiting the scope of the invention. In the drawings, like numbering represents like elements between the drawings.

The detailed description explains embodiments of the invention, together with advantages and features, by way of example with reference to the drawings.

DETAILED DESCRIPTION OF THE INVENTION

Figure 1:
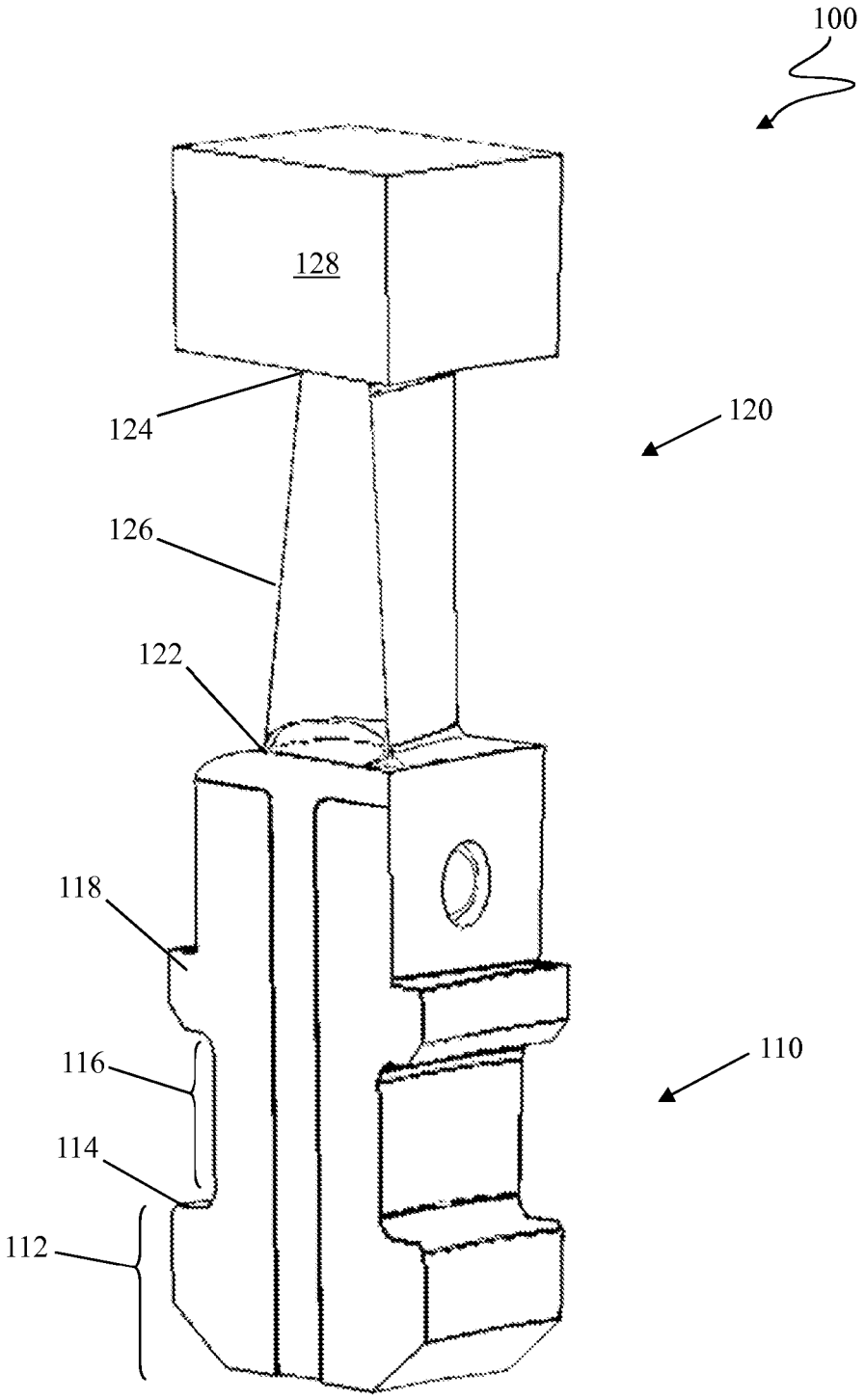
FIG. 1 shows a schematic elevation diagram of a first example of a locking blade according to embodiments of the invention disclosed herein.

With reference to FIG. 1, a locking blade 100 for a rotor can include a bucket dovetail 110 that can support a blade body 120. A blade hook portion 112 of bucket dovetail 110 can include blade hook shoulders 114 configured to interact with a dovetail assembly of a rotor (not shown) so that bucket dovetail 110, and hence locking blade 100, can be retained against radial motion or motion out of the rotor. A shaft or neck portion 116 can extend from blade hook portion 112 toward blade body 120 supported by bucket dovetail 110. In embodiments, bucket dovetail 110 can include upper shoulders or bucket platform 118 in an upper portion of bucket dovetail 110 that can also be configured to interact with the rotor so as to assist in securing bucket dovetail 110 in position. As also seen in FIG. 1, blade body 120 can include a base or root 122 at one end, which can be attached to bucket dovetail 110, and a tip 124 at an opposite end. Blade body 120 can further include an airfoil portion 126 between root 122 and tip 124, which airfoil portion 126 can have a profile that can vary over a length of blade body 120 as may be desired and/or appropriate, such as to improve blade efficiency. In embodiments, tip 124 can support or carry a cover block 128 configured to engage adjacent cover blocks 128 of adjacent blades 120 in an assembly.

Figure 2:
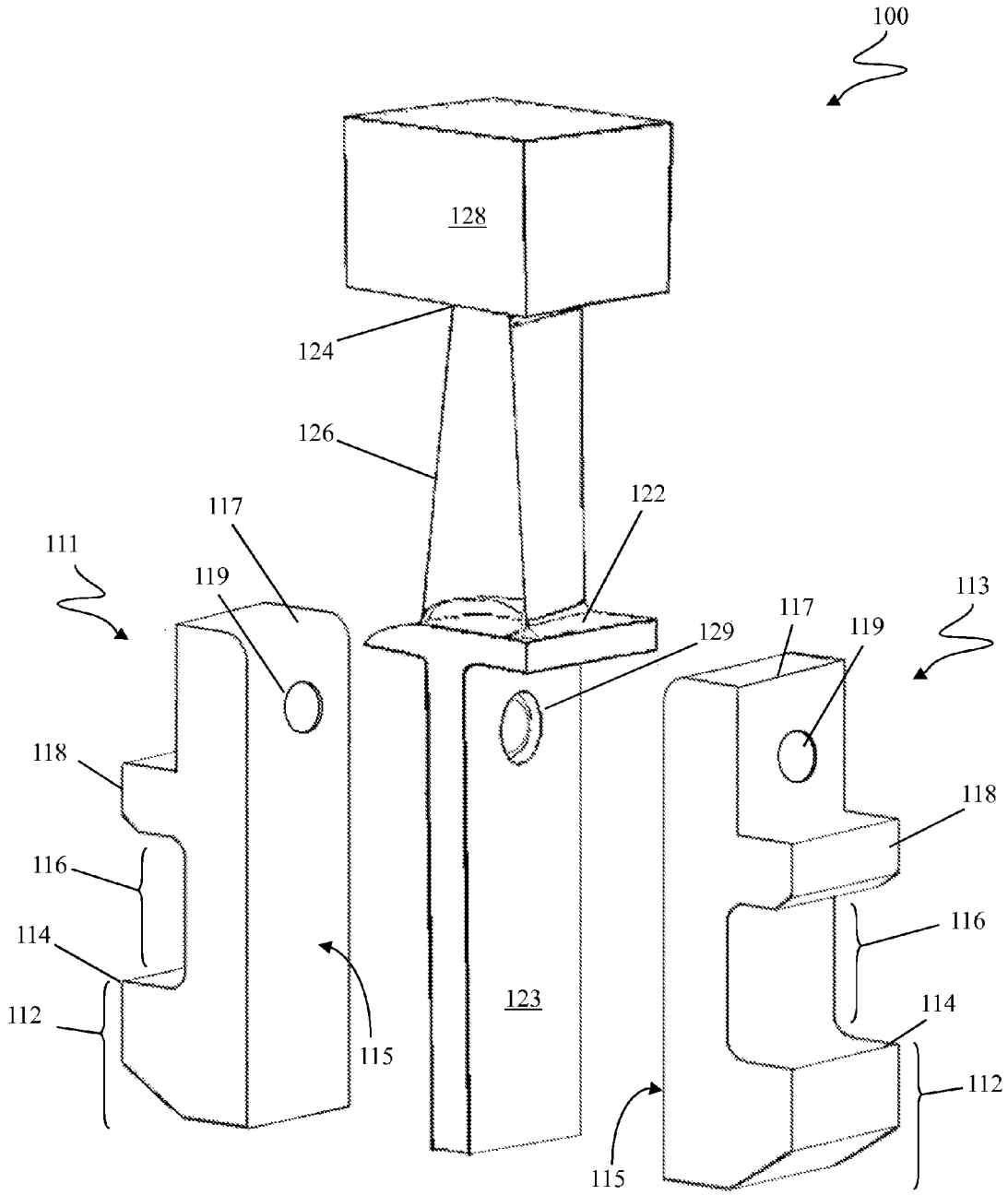
FIG. 2 shows an exploded schematic elevation diagram of the first example of a locking blade according to embodiments of the invention disclosed herein.
Figure 3:
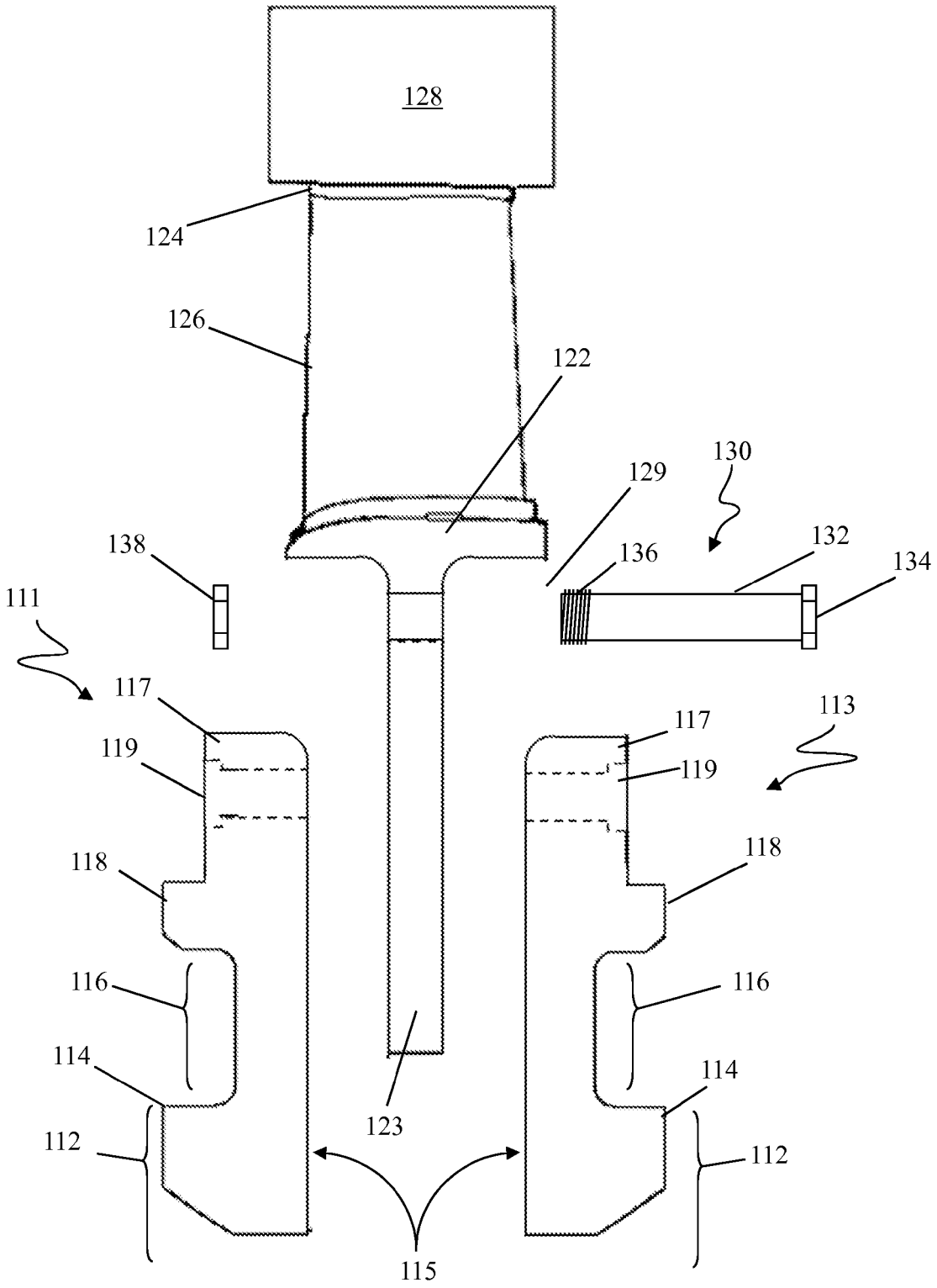
FIG. 3 shows an exploded schematic cross sectional diagram of the first example of a locking blade according to embodiments of the invention disclosed herein.
Figure 4:
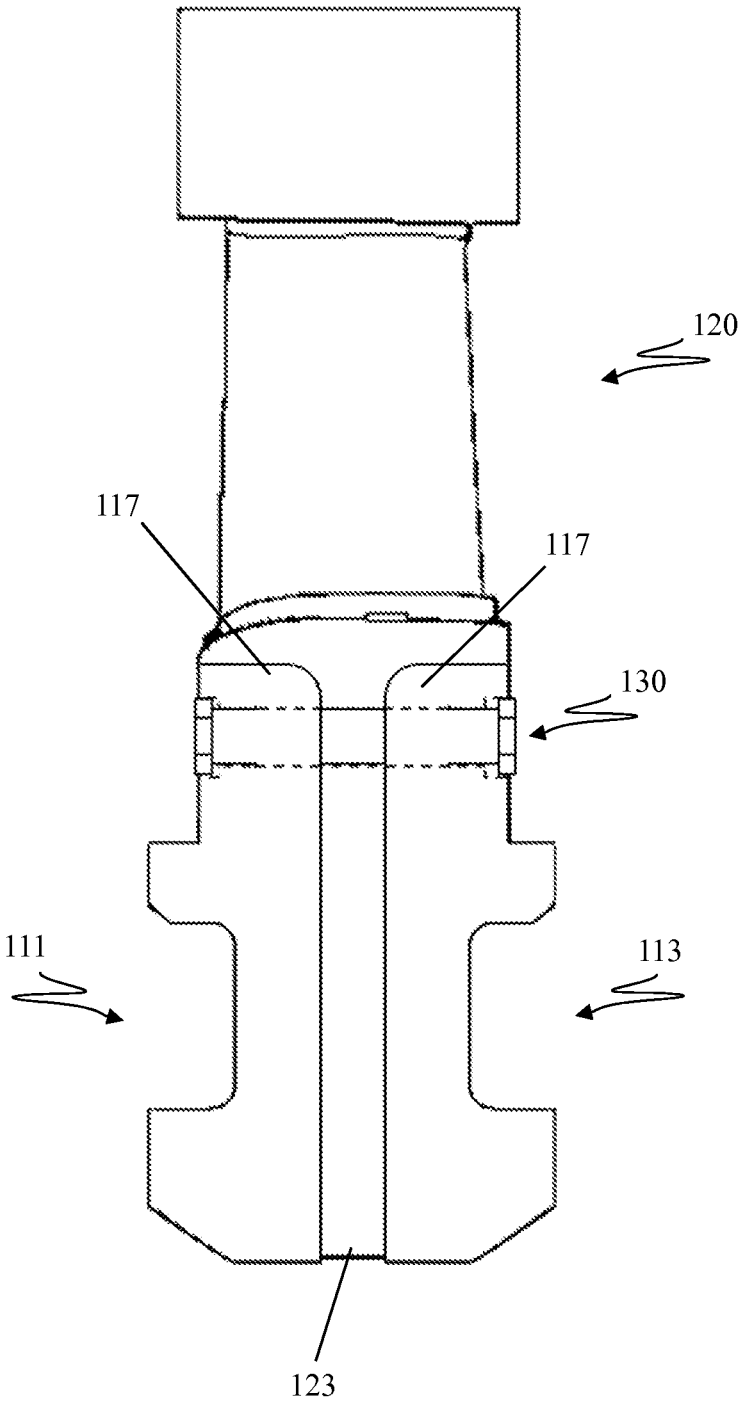
FIG. 4 shows a schematic cross sectional diagram of the first example of a locking blade assembled according to embodiments of the invention disclosed herein.
Figure 5:
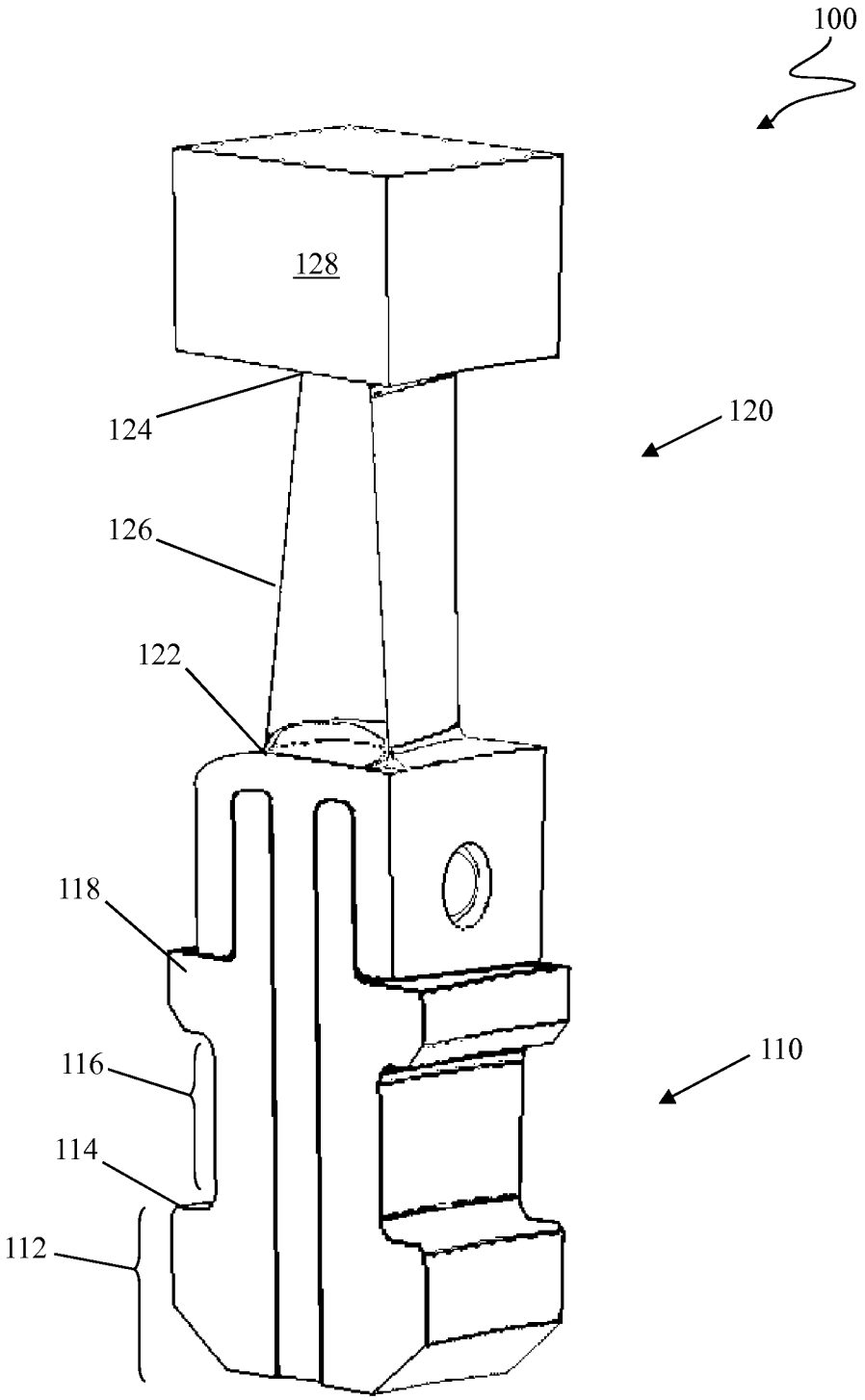
FIG. 5 shows a schematic elevation diagram of a second example of a locking blade according to embodiments of the invention disclosed herein.
Figure 6:
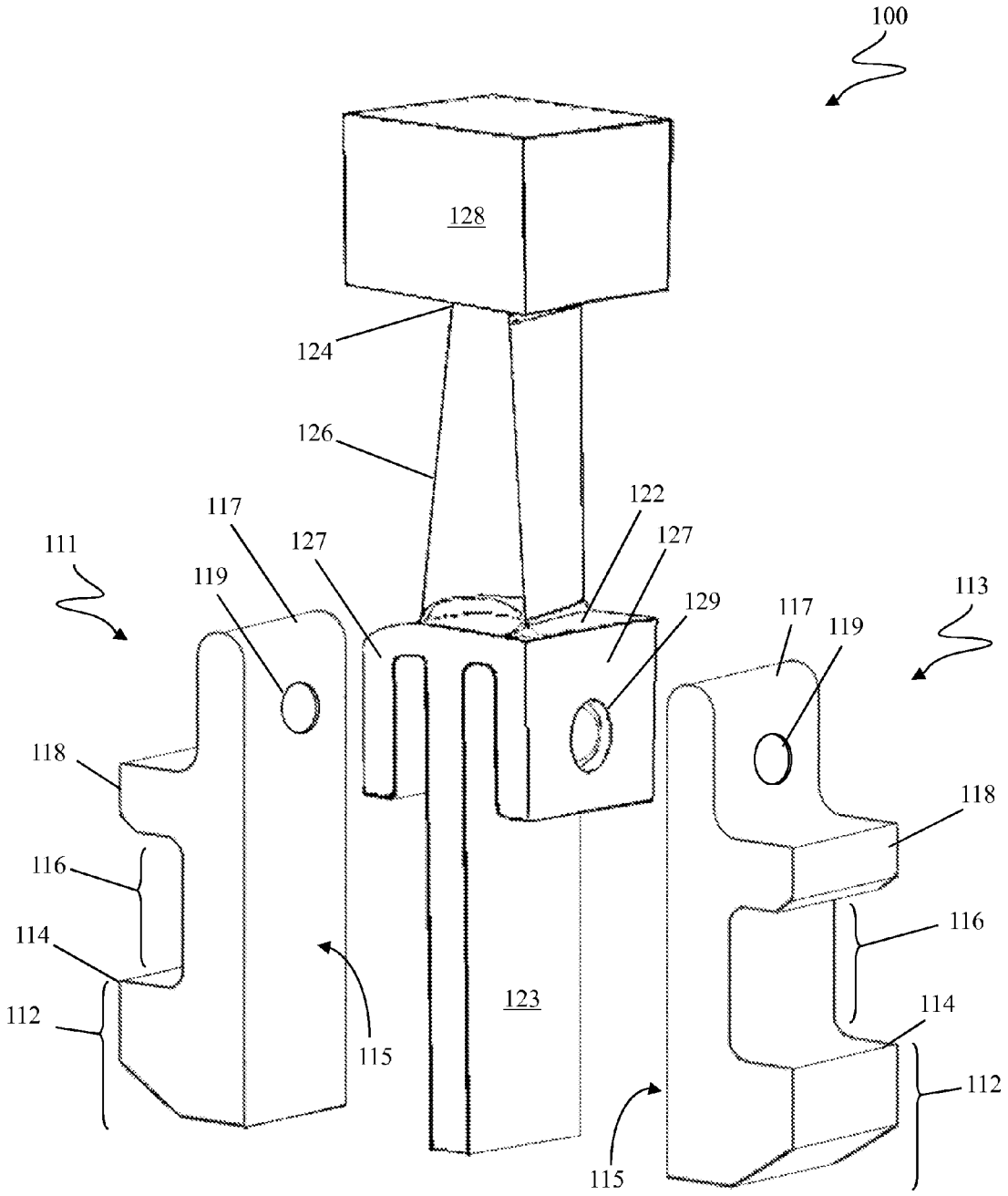
FIG. 6 shows an exploded schematic elevation diagram of the second example of a locking blade according to embodiments of the invention disclosed herein.
Figure 7:
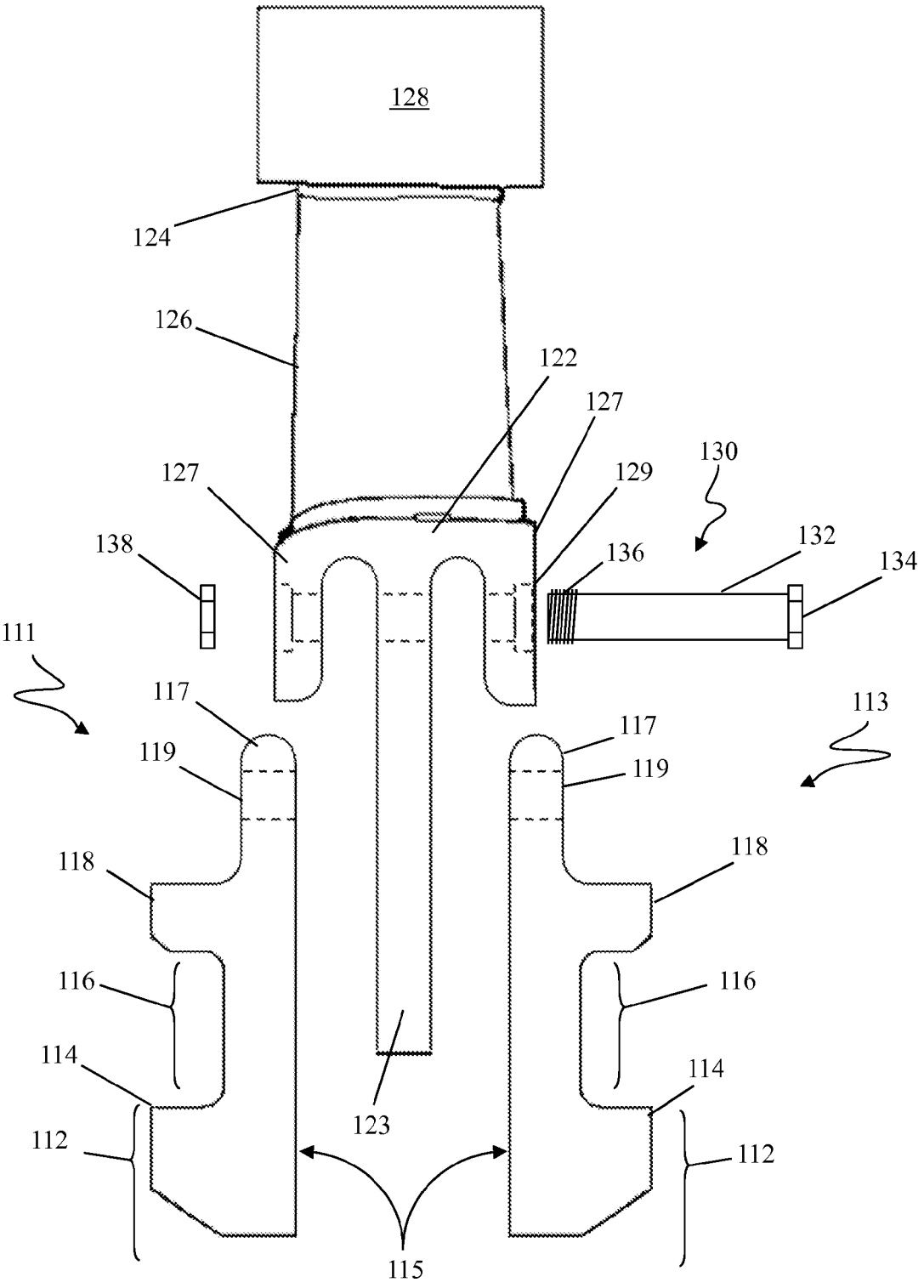
FIG. 7 shows an exploded schematic cross sectional diagram of the second example of a locking blade according to embodiments of the invention disclosed herein.
Figure 8:
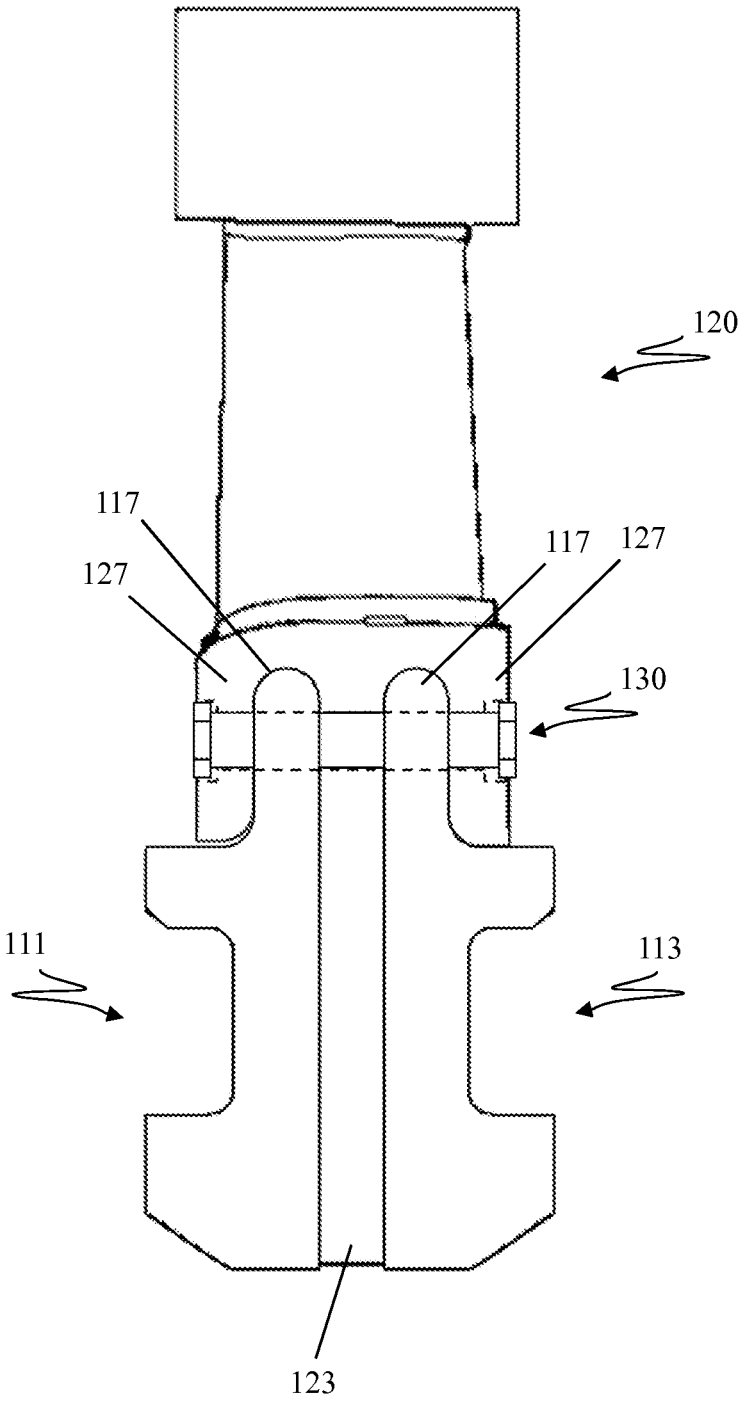
FIG. 8 shows a schematic cross sectional diagram of the second example of a locking blade assembled according to embodiments of the invention disclosed herein.

As seen in FIGS. 2-4, bucket dovetail 110 can include two segments or portions: a first bucket segment 111 and a second bucket segment 113. In embodiments, with particular reference to FIGS. 2 and 3, each of first and second bucket segments 111, 113 can include an engagement surface 115 that can engage a tongue 123 that projects from base or root 122 of blade body 120. For example, first and second bucket segments 111, 113 can be disposed on opposite sides of tongue 123 so that each engagement surface 115 can engage a respective side surface of tongue 123. Each bucket segment 111, 113 can also include a flange that can extend from bucket platform 118 toward root 122 of blade body 120. Engagement surface 115 can extend along flange 117, in embodiments, and/or to a bottom of blade hook portion 112. Each flange 117 can include a bucket through hole 119 configured to register with a root through hole 129 in tongue 123 to allow insertion of a fastener 130 (FIGS. 3 and 4). For example, fastener 130 can be a pin 132 inserted into through holes 119, 129 once tongue 123 has been inserted between first and second bucket segments 111, 113 and/or once first and second bucket segments have been placed in engagement with tongue 123. Pin 132 can include a head 134, and in embodiments pin 132 can take the form of or be replaced with a bolt with threads 136 that can screw into corresponding threads in one through hole and/or in a nut 138. Fastener 130, whether it be a pin, a bolt, or another suitable fastener, thereby can hold blade body 120 against relative longitudinal motion with respect to first and second bucket segments 111, 113 so that blade hook shoulders 114 can retain locking blade 100 in a rotor (not shown).

An additional example of a locking blade 100 according to embodiments of the invention disclosed herein is shown in FIGS. 5-8. To enhance interaction between tongue 123 and engagement surfaces 115, as particularly seen in FIGS. 6-8, blade body 120 can include tines 127 extending from root 122 toward blade hook portion 112 and spaced apart from tongue 123. Tines 127 and flanges 117 can be correspondingly sized so that a respective flange 117 can be received between each tine 127 and tongue 123. Each tine 127 can include an additional root through hole 129 in alignment with each other, root through hole 129 of tongue 123, and bucket through holes 119 to that fastener 130 can be inserted therethrough. In addition, it should be noted that while fastener 130 has been described as a pin or a bolt, embodiments can employ any fastener as may be suitable and/or desirable.

The examples of FIGS. 1-8 show first and second bucket segments 111, 113 having substantially identical profiles. It should be recognized that first and second bucket segments 111, 113 could have different profiles where desired and/or appropriate. In addition, while a single compound passage comprising through holes 119, 129 is shown, receiving a single pin, it should be clear that other configurations with other numbers of through holes and/or fasteners could be employed.

In operation, locking blade 100 would be a final blade installed on a rotor. In other words, a plurality of substantially identical blades would be inserted into a circumferential groove or the like in a rotor, leaving space for one more blade. Locking blade 100 can be inserted into this last space, such as by inserting each bucket segment 111, 113 into a respective region of the space, then inserting tongue 123 and/or tines 127 of blade body 120 between bucket segments 127.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A locking blade for a rotor, the locking blade comprising:

a blade body portion including a tip at a first end and a root at a second end opposite the first end, the root including a tongue extending away from the tip; and a bucket portion including a bucket dovetail having a blade hook portion, wherein the bucket portion includes a first bucket segment and an opposed, substantially identical second bucket segment, wherein each bucket segment includes a respective side opposite a respective engagement surface having a blade hook shoulder configured to retain the locking blade on a rotating body and an upper shoulder configured to retain the locking blade on the rotating body, wherein the bucket dovetail is configured to receive and retain the tongue against relative motion with respect to the bucket dovetail, wherein the tongue includes a root through hole and each bucket segment further includes a respective bucket through hole that selectively registers with the tongue root through hole, the locking blade further comprising a fastener configured to extend through the tongue root and bucket through holes, thereby retaining the tongue against relative motion with respect to the bucket segments, and wherein each bucket segment further includes a respective portion of the bucket dovetail that has the respective engagement surface configured to engage the tongue.

2. The locking blade of claim 1, wherein the root further comprises first and second tines extending substantially parallel to and spaced apart from the tongue, each tine including a respective root through hole that registers with the tongue root through hole, and each bucket segment including a flange that selectively projects between a respective tine and the tongue, each flange bearing the respective bucket through hole such that the root through hole of the tongue, the root through holes of the tines, and the bucket through holes register and the fastener selectively extends therethrough.

3. The locking blade of claim 2, wherein each bucket segment dovetail portion includes a profile wherein the flange extends from a first end of the bucket segment and the engagement surface extends along a side of the flange and the bucket segment to a second end of the bucket segment opposite the first end.

4. The locking blade of claim 2, wherein each bucket segment dovetail portion includes a profile wherein a side of the bucket segment opposite the engagement surface includes an upper shoulder selectively engaged by an end of a respective tine of the blade portion.

5. A locking blade for a rotor, the locking blade comprising:

a blade body and a bucket dovetail, the bucket dovetail being configured to support the locking blade and to be retained against radial movement in and by a substantially circumferential wheel dovetail in the rotor, the bucket dovetail further being configured to retain the blade body against movement relative to the bucket dovetail;

a tongue extending from a root of the blade body and including a root through hole configured to allow a fastener to extend therethrough;

a first bucket segment configured to engage a first side of the tongue and including a first bucket through hole that selectively registers with the root through hole of the tongue, wherein;

a second bucket segment configured to engage a second side of the tongue and including a second bucket through hole that selectively registers with the root through hole of the tongue and the first bucket through hole, wherein each bucket segment includes a blade hook shoulder and an upper shoulder, each configured to engage and be retained against exit from the wheel dovetail; and a fastener configured to extend through the root and bucket through holes of the bucket segments and the tongue, respectively, thereby retaining the blade body-against movement relative to the bucket dovetail.

6. The locking blade of claim 5, further comprising first and second tines extending from the root of the blade body substantially parallel to and on opposite sides of the tongue such that a first end of each bucket segment can be received between a respective tine and the tongue.

7. The locking blade of claim 6, wherein the tines each have a root through hole that registers with the root through hole of the tongue and with the bucket through holes when the first ends of the bucket segments are received between the tines and the tongue so that the fastener selectively extends through the bucket segments, the tongue, and the tines.

8. A locking blade for a rotor, the locking blade comprising:

a blade body including a root;

at least one tine extending from the root;

a bucket dovetail including substantially identical first and second bucket segments, each bucket segment including a respective engagement surface configured to engage a respective surface of the at least one tine, and wherein each bucket segment includes a respective side opposite a respective engagement surface having a blade hook shoulder configured to retain the locking blade on a rotating body and an upper shoulder configured to retain the locking blade on a rotating body;

corresponding through holes formed in each of the at least one tine and each of the bucket segments so that the through holes register with each other when the engagement surfaces are engaged; and a fastener configured for insertion through the through holes when the engagement surfaces engage the at least one tine, thereby constraining the tongue against motion out of the bucket dovetail.

9. The locking blade of claim 8, wherein the fastener includes a bolt with a head at one end and threads at an opposite end.

10. The locking blade of claim 8, wherein the fastener includes a pin.

11. The locking blade of claim 8, wherein the blade body further comprises at least two tines substantially parallel to and spaced apart from each other so as to receive a flange of at least one of the first or second bucket segments.

12. The locking blade of claim 11, wherein the at least two tines comprise first and second tines and wherein the blade body further includes a tongue extending from the root substantially parallel to and between the tines so that a flange of the first bucket segment can be received between the tongue and the first tine and a flange of the second bucket segment can be received between the tongue and the second tine, the tongue including a through hole that registers with the through holes of the tines.

* * * * *